United States Patent [19]

Sturm

[11] Patent Number: 4,847,918

[45] Date of Patent: Jul. 18, 1989

[54] PROTECTIVE HAND CONVERING AND METHOD OF MANUFACTURE

[75] Inventor: Frank C. Sturm, Alexandria, Ind.

[73] Assignee: The Glove Corporation, Alexandria, Ind.

[21] Appl. No.: 194,474

[22] Filed: May 16, 1988

[51] Int. Cl.[4] ..... A41D 13/10

[52] U.S. Cl. ..... 2/161 R; 2/164; 2/167; 2/169

[58] Field of Search ..... 2/161 R, 163, 164, 167, 2/168, 169, 158, 159, 16

[56] References Cited

U.S. PATENT DOCUMENTS

| | | | |
|---|---|---|---|
| 897,306 | 9/1908 | Rosenfeld | 2/164 X |
| 2,343,220 | 2/1944 | Mason | 2/168 |
| 2,446,921 | 8/1948 | Grant | 2/168 |
| 4,430,759 | 2/1984 | Jackrel | 2/164 |
| 4,433,439 | 2/1984 | Sidman | 2/161 R |
| 4,454,611 | 6/1984 | Tschirch et al. | 2/161 R |
| 4,679,257 | 7/1987 | Town | 2/164 |
| 4,727,602 | 3/1988 | Giese et al. | 2/161 R X |

*Primary Examiner*—Peter Nerbun
*Attorney, Agent, or Firm*—Jack Schuman

[57] ABSTRACT

A flexible fire-retardant and heat insulating inner glove is mounted within and cemented to a flexible, water-tight, vapor-permeable plastic glove. A flexible reinforcement element having the outline of the plastic glove, with fingers somewhat longer than the fingers of the plastic glove, is cemented to one face of the plastic glove, in substantial registry therewith, the fingers of the reinforcement element extending beyond the fingers of the plastic glove to provide securement tabs. These securement tabs are stitched or tacked to the tips of the fingers of a reversed (i.e., inside-out) leather glove, which is then pulled over (i.e., reversed so as to be outside-out) the plastic glove and reinforcement element.

14 Claims, 1 Drawing Sheet

PROTECTIVE HAND CONVERING AND METHOD OF MANUFACTURE

BACKGROUND OF THE INVENTION

1. Field of the Invention

This invention relates broadly to protective hand coverings such as gloves and the like and to a method of making such protective hand coverings.

More specifically, this invention relates to a glove particularly adapted to be worn by a firefighter to protect the hand against liquids and heat and steam burns, while permitting a high degree of flexibility of the hand, and to a method of making such glove.

2. Description of the Prior Art

U.S. Pat. No. 4,454,611 (1984) to Tschirch et al. discloses a heat-resistant glove having a shell of temperature-resistant fabric, the outer surface of which is coated with a fire-resistant elastomer. A non-waterproof liner of temperature-resistant fabric is inserted in the shell, and is secured to the shell by sewing at suitable strain locations.

U.S. Pat. No. 3,548,413 (1970) to Jackson discloses a fireplace glove with inner and outer glove parts secured to each other by peripheral stitching around the cuff to permit the palm and finger portions of the interfitted gloves to move relative to each other to prevent heat buildup.

U.S. Pat. No. 2,446,921 (1948) to Grant discloses a rubber glove with an inner fibrous glove or liner. Tips on the ends of the fingers of the inner fibrous glove are connected to the insides of the fingers of the rubber glove in such a manner as to provide air pockets thereby to protect the fingertips of the wearer against heat.

U.S. Pat. No. 897,306 (1908) to Rosenfeld discloses a double-walled non-waterproof non-high temperature resistant glove formed by fabricating the glove with extended extra finger and palm portions which are then reversed to provide double layers at the finger and palm portions of the glove.

U.S. Pat. No. 2,343,220 (1944) to Mason discloses a fabric glove which may be rubberized so as to be waterproof, constructed in such a manner as to provide a fixed initial inclination (i.e., prebending) of the finger portions of the glove relative to the palm portion.

None of the prior art patents mentioned above discloses a glove particularly adapted to protect the hand against heat, undesirable liquids and steam burn, as well as against abrasion and the like, while permitting improved dexterity of the hand, nor does any of this prior art disclose an improved method for making such a glove.

SUMMARY OF THE INVENTION

One of the objects of this invention is to provide an improved protective hand covering.

Another of the objects of this invention is to provide an improved method for making a protective hand covering.

A particular object of this invention is to provide an improved fireman's glove to protect the hand against heat, undesirable liquids and steam burns, as well as against abrasion and the like, while permitting improved dexterity of the hand.

Yet another particular object of this invention is to provide an improved method for making a fireman's glove.

Other and further objects of this invention will become apparent by reference to the accompanying specification and drawings, and to the appended claims.

Briefly, I have discovered that the foregoing objects may be attained by securing a flexible fire-retardant and heat insulating fabric liner or inner glove within a thin, flexible, watertight and vapor-permeable plastic glove, as by cementing, and then securing, as by cementing, to one face of the plastic glove, in substantial registry therewith, a tear-resistant, flexible reinforcement element having an outline substantially similar to the outline of the face of the plastic glove, the fingers of the reinforcement element extending beyond the fingers of the plastic glove. Thereafter, those portions of the fingers of the reinforcement element extending beyond the fingers of the plastic glove are secured, as by stitching or tacking, to the fingertips of a flexible leather outer glove or shell which has been turned inside-out. Finally, the leather outer glove is reversed and pulled over the plastic glove and reinforcement element so that the leather glove is now right-side out.

DESCRIPTION OF THE DRAWINGS

Referring now to the drawings in which like numerals represent like parts in the several views.

DESCRIPTION OF THE PREFERRED EMBODIMENT

Figure 1:
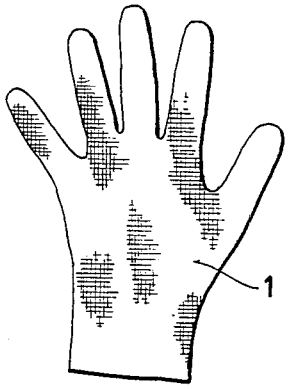
FIG. 1 represents a view in plan of a face of the fabric liner or inner glove.

Inner glove or liner 1, shown in FIG. 1, is made of a fabric material which is fire retardant and heat insulating, and is sized and adapted to fit comfortably on the wearer's hand. In the preferred embodiment, inner glove 1 is made entirely of a polyester material, although other materials with fire retardant and heat insulating properties are known in the art and may also be used. The material from which inner glove 1 is made is flexible, so that the wearer's hand and fingers (which latter term as used in this specification and in the claims is intended to include all digits of the hand including the thumb) can, together with inner glove 1, be flexed with dexterity while the hand is in the inner glove 1.

Figure 2:
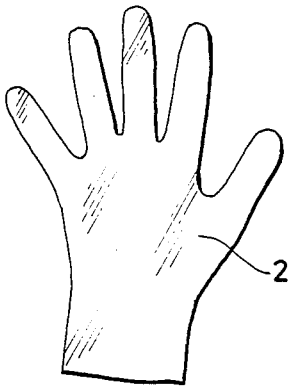
FIG. 2 represents a view in plan of a face of the plastic glove.

Plastic glove 2, shown in FIG. 2, is made from a thin, flexible, waterproof and vapor permeable polymeric sheet material. Such polymeric sheet materials are available and are known in the art. In the preferred embodiment, the sheet material is a laminate of GORE-TEX TM polymer and TEFLON TM polymer and the glove 2 is fabricated with the TEFLON TM surface on the outside. In another embodiment, the sheet material from which glove 2 is made may be a single layer of polymeric material such as PORELLE TM polymer.

Figure 3:
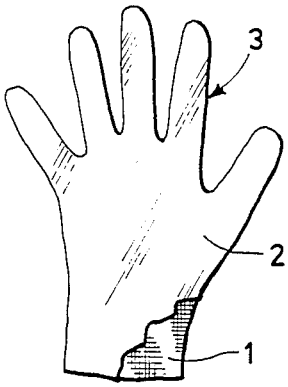
FIG. 3 represents a view in plan, partially broken away, of a face of the inner assembly of inner glove and plastic glove.

Inner glove 1 is mounted within and suitably secured to plastic glove 2, the fingers of inner glove 1 being inserted into their respective fingers of plastic glove 2, thereby to form inner assembly 3 as shown in FIG. 3. In the preferred manner of securing the inner glove 1 within plastic glove 2, a suitable adhesive or cement is applied to both faces of the inner glove 1 before the plastic glove 2 is slipped over inner glove 1, to insure the proper degree of securement. Such a suitable adhesive or cement is a solid heat-softenable material sold under the trademark SHARNET TM which material will adhere in a satisfactory manner to fabric materials and also to polymeric materials including TEFLON TM materials, and when adhered in a thin coat will be flexible. Prior to heating, strips of the SHARNET TM material are held to inner glove 1 by means of glue applied by brush to both faces of inner glove 1. The plastic glove 2 is then slipped over the inner glove 1, and heat may be applied at this point to soften the SHARNET TM material and cause it to adhere to the inner surface of plastic glove 2. Alternatively, the heat may be applied at a later step, as hereinafter described.

Figure 4:
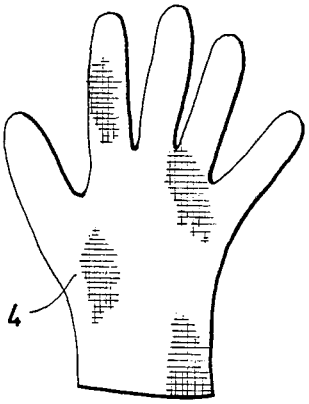
FIG. 4 represents a view in plan of that face of the reinforcement element which subsequently will be secured to a face of the inner assembly.

Reinforcement element 4 having an outline which is substantially similar to the outline of the face of plastic glove 2, sized as hereinbelow described, is shown in FIG. 4, and is cut, stamped or otherwise formed from material of strength sufficient to resist tearing, particularly when the hand of a wearer is removed from inner assembly 3 to which reinforcement 4 is subsequently secured. The material from which reinforcement element 4 is formed must also be thin and flexible so that, when secured to inner assembly 3, the wearer's hand and fingers can, together with inner assembly 3 and reinforcement element 4, be fixed with dexterity while the hand is in the inner glove 1.

Figure 5:
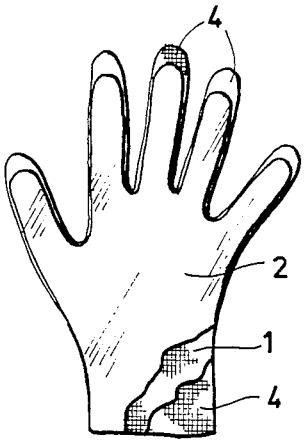
FIG. 5 represents a view in plan, partially broken away, of the inner assembly laid over and secured to the reinforcement element, showing the fingertips of the reinforcement element extending beyond the fingertips of the plastic glove of the inner assembly.
Figure 6:
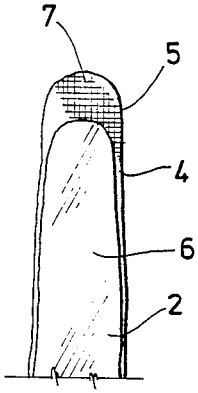
FIG. 6 represents an enlarged view of one finger of the reinforcement element and of the plastic glove of the inner assembly, and shows the finger of the reinforcement element extending beyond the tip of the finger of the plastic glove of the inner assembly.
Figure 7:
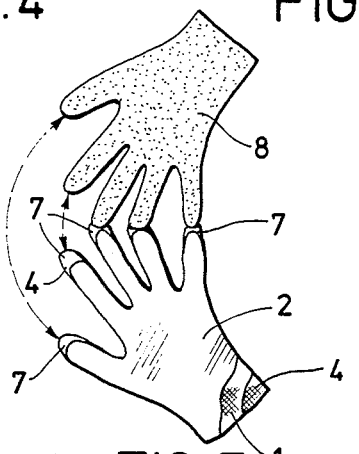
FIG. 7 represents a view in plan of the fingertips of the reinforcement element placed in juxtaposition to the fingertips of the reversed (i.e., inside-out) leather outer glove, preparatory to being secured thereto, indicating diagrammatically that the thumbtips and the tips of the index fingers of the reinforcement element and inverted leather outer glove likewise are to be juxtaposed preparatory to attachment to each other.
Figure 8:
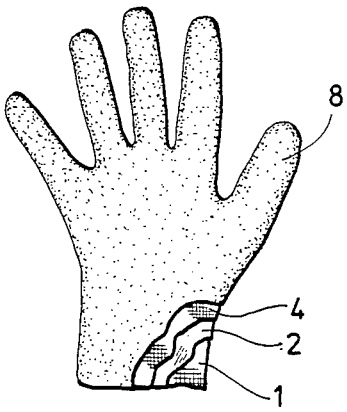
FIG. 8 represents a view in elevation, partially broken away, of the leather outer glove reversed (i.e., turned outside-out) and pulled over the inner assembly of inner glove and plastic glove and the reinforcement element.

Reinforcement element 4 substantially registers with one face of plastic glove 2 of the inner assembly 3 as shown in FIG. 5. As best shown in FIG. 6, each finger 5 of the reinforcement element 4 extends beyond the tip of its respective finger 6 of plastic glove 2 of the inner assembly 3 sufficiently to provide an extension 7 which will function as a securement tab to be attached to the tip of its respective finger of leather outer glove 8 as hereinafter described.

A suitable adhesive or cement is applied to one face of inner assembly 3 (viz., to one face of the outside of the plastic glove 2 of inner assembly 3). Such a suitable adhesive or cement is the SHARNET TM material hereinbefore mentioned. Reinforcement element 4 is placed in substantial registry with that face of inner assembly 3 bearing the adhesive, with the extensions 7 extending beyond the tips of fingers 6 of inner assembly 3. Heat is now applied to soften the SHARNET TM adhesive, thereby securely cementing reinforcement element 4 to one face of plastic glove 2 of inner assembly 3. At this point, it will be observed that, if the SHARNET TM adhesive previously applied to inner glove 1 has not already been heated so as to cement plastic glove 2 to inner glove 1, one heating operation can be employed to simultaneously soften the two SHARNET TM adhesives and secure reinforcement element 4 to the outside of, and inner glove 1 to the inside of, plastic glove 2.

Tear-resistant reinforcement element 4, so secured to substantially the entire face of plastic glove 2 of inner assembly 3, reinforces plastic glove 2 against forces which otherwise would result in tearing plastic glove 2 and destruction of the waterproof character of plastic glove 2, and will permit the hand of the wearer to be withdrawn from inner assembly 3 without tearing or rupturing plastic glove 2 when reinforcement element 4 is attached to leather outer glove 8 as hereinafter described.

In the next stage of manufacture of the protective hand covering, flexible leather outer glove 8 is reversed (i.e., turned inside-out) and the fingertips of reversed leather outer glove 8 are placed in juxtaposition to extensions 7 of their respective fingers 5 of the reinforcement element 4. Each extension 7 is now secured, as by stitching or tacking, to its respective fingertip of leather outer glove 8, after which the leather outer glove 8 is reversed again and pulled over inner assembly 3 and reinforcement element 4, so that the leather outer glove 8 is now right-side out and covers inner assembly 3 and reinforcement element 4. The assembled protective hand covering may be placed on a heated form in the shape of a hand to remove wrinkles in the inner assembly 3, this heated form in effect ironing out the wrinkles.

Inner glove 1, as previously noted, by virtue of its fire resistant and heat insulating properties, protects the hand of the wearer against high temperatures.

Plastic glove 2, as previously noted, is waterproof and protects the hand of the wearer against undesirable liquids such as very hot water. Because it is vapor permeable, water vapor generated on the hand of the wearer because of perspiration, can escape through plastic glove 2.

Reinforcement element 4, because of its adhesion to substantially the entire one face of plastic glove 2, prevents plastic glove 2 from tearing when the hand of the wearer is withdrawn from inner assembly 3.

Leather outer glove 8 protects the inner assembly 3 and the hand of the wearer from abrasion.

In this manner, a very satisfactory protective hand covering is provided.

The foregoing is considered as illustrative only of the principles of the invention. Further, since numerous modifications and changes will readily occur to those skilled in the art to which this invention pertains, it is not desired to limit the invention to the exact method and apparatus shown and described herein, and accordingly all suitable modifications and equivalents falling within the scope of the invention may be resorted to.

I claim:

1. Protective hand covering comprising:

(a) a flexible, fire-retardant, heat insulating inner glove having fingers, (b) a flexible, waterproof, vapor-permeable plastic glove having fingers, (c) first means securing said inner glove within said plastic glove, each finger of said plastic glove receiving one finger of said inner glove, said inner glove and plastic glove constituting an inner assembly, (d) flexible, tear resistant, reinforcement means having a face with an outline substantially similar to the outline of a face of said plastic glove of said inner assembly, (e) fingers on said reinforcement means, said fingers being longer than the fingers on said plastic glove of said inner assembly, (f) second means securing the face of said reinforcement means to, and in substantial registry with, the exterior of one face of said plastic glove of said inner assembly, each finger of said reinforcement means extending beyond the tip of one finger of said plastic glove, (g) those portions of the fingers of said reinforcement means extending beyond the tips of the fingers of the plastic glove defining securement tabs, (h) a flexible, abrasion-resistant outer glove to receive said inner assembly and having fingers, (i) third means securing each securement tab to the inside of the tip of one finger of said outer glove, (j) whereby the said inner assembly is secured within said outer glove.

2. Protective hand covering as in claim 1, wherein:

(k) said inner glove is a fabric.

3. Protective hand covering as in claim 1, wherein:

(k) said first means is a flexible adhesive applied to substantially entirely one face of each of the inner glove and the plastic glove.

4. Protective hand covering as in claim 1, wherein:

(k) said flexible reinforcement means is a fabric.

5. Protective hand covering as in claim 1, wherein:

(k) said second means is a flexible adhesive applied to substantially entirely the exterior of one face of the plastic glove and substantially entirely to one face of said reinforcement means.

6. Protective hand covering as in claim 1, wherein:

(k) said outer glove is leather.

7. Protective hand covering as in claim 1, wherein:

(k) said third means is stitching.

8. Protective hand covering as in claim 1, wherein:

(k) said third means is tacking.

9. Method for making a protective hand covering, comprising the steps of:

(a) securing a flexible, fire-retardant, heat insulating inner glove within a flexible, waterproof, vapor-permeable plastic glove, (b) securing to substantially the entire surface of one exterior face of the plastic glove a flexible, tear-resistant reinforcement element having the outline of the said exterior face of the plastic glove with the fingers of the reinforcement element extending beyond the tips of the fingers of the plastic glove, (c) reversing a flexible outer glove so that it is inside-out, (d) securing those portions of the fingers of said reinforcement element extending beyond the tips of the fingers of the plastic glove to the tips of the fingers of the reversed outer glove, (e) reversing the outer glove over the plastic glove so that the outer glove is right-side-out, and the plastic glove and inner glove within the plastic glove are inside the outer glove.

10. Method as in claim 9, wherein step (a) is performed by cementing the inner glove to the inside of the plastic glove.

11. Method as in claim 9 wherein step (b) is performed by cementing the reinforcement element to the exterior face of the plastic glove.

12. Method as in claim 9, wherein step (d) is performed by stitching the tips of the fingers of the reinforcement element to the tips of the fingers of the outer glove.

13. Method as in claim 9 wherein step (d) is performed by tacking the tips of the fingers of the reinforcement element to the tips of the fingers of the outer glove.

14. Method as in claim 9, further comprising:

(f) subsequent to step (e), placing the assembled outer glove, plastic glove and inner glove on a heated form to iron out wrinkles that may have occurred during the process of manufacture.

* * * * *